US006109273A

United States Patent [19]

Schleicher

[11] Patent Number: 6,109,273

[45] Date of Patent: Aug. 29, 2000

[54] DUAL BLADE TEASE COMB AND HAIR PICK

[76] Inventor: Nancy G. Schleicher, 113 Bruton Cir., Greenville, N.C. 27858

[21] Appl. No.: 09/337,440

[22] Filed: Jun. 21, 1999

[51] Int. Cl.[7] ..... A45D 24/00

[52] U.S. Cl. ..... 132/200; 132/129

[58] Field of Search ..... 132/200, 126, 132/129, 136, 161, 137, 142

[56] References Cited

U.S. PATENT DOCUMENTS

| | | | |
|---|---|---|---|
| 930,678 | 8/1909 | Moore | 132/126 |
| 1,580,365 | 4/1926 | Bechtold | 132/137 |
| 1,950,667 | 3/1934 | Fulton | 132/142 |
| 2,334,737 | 11/1943 | Woodruff | 132/136 |
| 2,408,142 | 9/1946 | Hollenbeck | 132/137 |
| 3,107,665 | 10/1963 | Nordgren | 132/142 |
| 3,473,540 | 10/1969 | Bulow | 132/139 |
| 3,603,324 | 9/1971 | Cutrone | 132/136 |

FOREIGN PATENT DOCUMENTS

| | | | |
|---|---|---|---|
| 1021071 | 2/1953 | France | 132/135 |
| 641571 | 1/1937 | Germany | 132/136 |
| 363011 | 12/1931 | United Kingdom | 132/136 |

*Primary Examiner*—Todd E. Manahan
*Attorney, Agent, or Firm*—Mills Law Firm PLLC

[57] ABSTRACT

A dual blade teasing comb and hair pick includes a laterally space pair of comb blades, each including an elongated spine having a longitudinal series of teeth depending therefrom and an elongated rearwardly extending cylindrical hair. The combs may be pivotally and slidably interconnect whereby the comb teeth are effective for increasing teased volume during backcombing and the picks may be pivoted to permit repositioning of the teased volume.

7 Claims, 4 Drawing Sheets

DUAL BLADE TEASE COMB AND HAIR PICK

FIELD OF THE INVENTION

The present invention relates to hairstyling, and, in particular to an improved tease comb and hair pick for increasing the volume and speed of backcombing and facilitating its placement.

BACKGROUND OF THE INVENTION

Various techniques are employed by individuals and hair stylists in smoothing hair and giving the hair illness and height. Normal brushing and combing for smoothing hair is readily accomplished without undue skills and a multitude of satisfactory products are conventionally employed. Backcombing and teasing, however, require substantially greater skills to achieve the desired effect.

Teasing or backcombing generally involves combing small portions of the hair ends toward the scalp and establishing a mat adjacent the scalp that forms a cushion or base. Such techniques are also known as ratting, lacing, roughing or fluffing. The purpose of such techniques is to increase the apparent volume of hair preparatory to final combing. These effects are accomplished by lifting portions of hair strands and combing them from the outer ends toward the scalp, as opposed to general smoothing wherein the motion is from the scalp toward the outer ends. By rapid back and forth movement, a portion of the strands are compacted against the scalp to create the volume. After creation of the volume, hair picks are used to raise the hair mass from the scalp to achieve the desired styling effect.

The skills and dexterity required for achieving these effects are difficult for individuals to master, and even professionals require considerable experience in order to create backcombed volume in an effective and efficient manner, and to reposition the volume for optimum effect. Recognizing these limitations, many specialized combs, brushes and pick constructions have been proposed to increase the formation of the backcombed volume and to reduce the skills necessary for its creation.

In one approach widely commercially used, a combined comb and hair pick employs a longitudinal series of regular length teeth that are periodically interrupted by an intermittent series of shorter length teeth. It is thoughts by many hair stylists that the shorter teeth have the effect of forcing greater numbers of hair strands toward the scalp without reextending these strands during the backstroke. The integral hair pick allows the user to probe and reposition the volume without using a separate tool. Nonetheless, considerable skill is required to master the required manipulative skills for creating and positioning the styling effect.

Other comb and brush modifications have been proposed to increase the volume and to reduce the skills attendant to teasing for volume and picking for placement. For example, U.S. Pat. No. 4,917,129 to Olson provides a tease comb/hair pick having teeth of three different lengths and of varying cross section, i.e. circular and oval. Such arrangement is proposed as a basis for increasing volume and reducing tangling and knotting.

U.S. Pat. No. 5,694,953 to Stephan et. al. provides a hairdressing comb having a series of spaced pairs of hair lifting teeth with opposed, staggered barbs that selectively engages portions of the strands to lift them during the upward brushing for selective streaking and like purposes.

U.S. Pat. No. 3,628,545 to Moody proposes using a high friction material at the base of conventional low friction comb teeth. Such a format is suggested as a technique for increasing formation of compacted hair strands during forward brushing movement. U.S. Pat. No. D389,271 to Celik provides enlarged roots for the teeth that are inclined relative to the tips, apparently also providing differential gripping effects for the hair strands during the teasing thereof.

In U.S. Pat. No. 3,603,323 to Avella, opposed combs that may be actuated toward one another into juxtaposed overlapping engagement to increase engagement on hair strands during forward movement. The combs are biased away from each other during the return-combing stroke.

The foregoing approaches while increasing movement of hair strands toward said scalp require considerable dexterity to avoid overly compacting hair mass during the forward stroke, and to release sufficient hair strands during the return stroke to establish an orderly buildup of the teased volume in the desired areas and achieve the intended styling effect. Moreover, to the extent a pick capability is provided on the comb, the hair engagement surface is essentially linear resulting in only localized lifting that can distort the teased volume and require substantial time consuming repetition to achieve the desired result.

SUMMARY OF THE INVENTION

The present invention provides a dual blade tease comb and hair pick that can be readily used by individuals and professionals, employs conventional backcombing techniques, creates quickly and efficiently desired teased volumes at easily controlled locations, and conveniently repositions the teased volume at desired locations without distortion. More particularly, the tease comb and hair pick of the present invention provides a pair of comb and pick units that are positioned in parallel, laterally spaced relationship and pivotally and longitudinally slidably interconnected to establish a multiplicity of closely spaced teeth, the juxtaposition and angularity of which can be easily controlled to effect discrete localized preferential gripping and matting of controlled amounts of hair. Tandem movement of the comb and pick using conventional backcombing techniques quickly compresses the hair into a teased volume that can be repositioned by controlled divergence and lifting of the picks.

Accordingly, it is an object of the present invention to provide a hairstyling device for quickly establishing and positioning teased hair volumes using conventional backcombing techniques.

Another object of the invention is to provide a dual bladed tease comb having tandem spaced sets of teeth effective for increasing the teasing effect during hairstyling.

A further object of the invention is to provide a method of hairstyling using successive comb teeth sets to increase teased hair mass during repeated backcombing strokes.

DESCRIPTION OF THE DRAWINGS

The above and other objects and advantages of the present invention will become apparent upon reading the following detailed description, taken in conjunction with the accompanying drawings in which.

DETAILED DESCRIPTION OF THE PREFERRED EMBODIMENTS

Figure 1B:
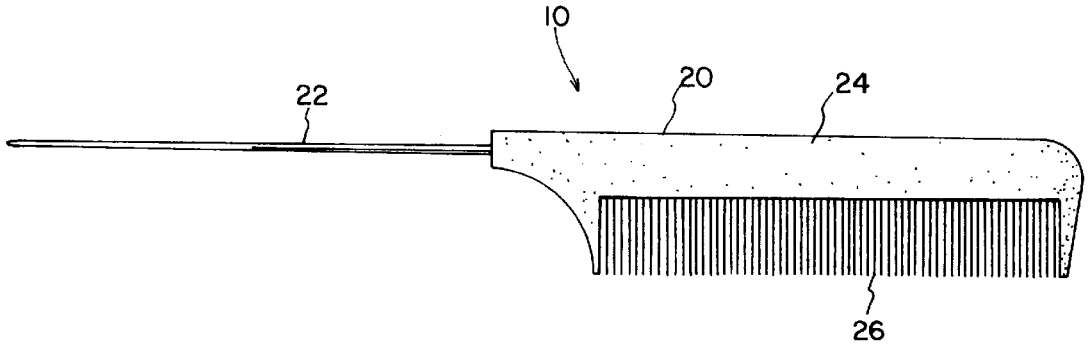
FIG. 1B is a side elevational view of another embodiment of the invention using fixed comb blades.
Figure 1A:
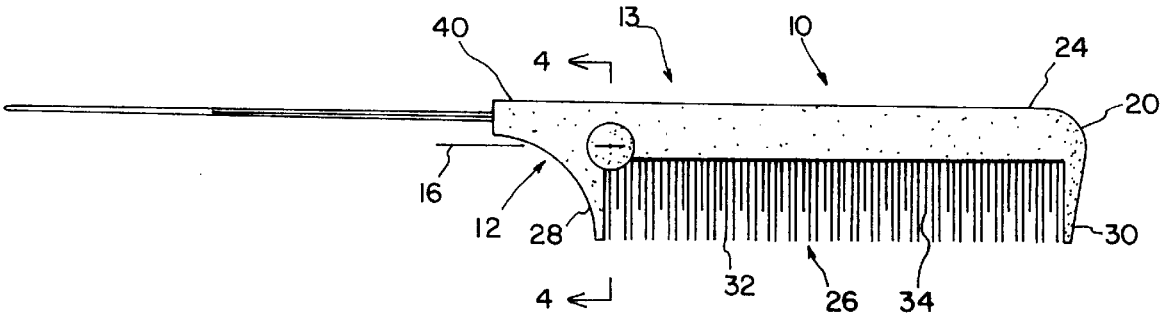
FIG. 1A is a side elevational view of the dual blade tease and pick comb in accordance with one embodiment of the present invention using pivotal comb blades.
Figure 2:
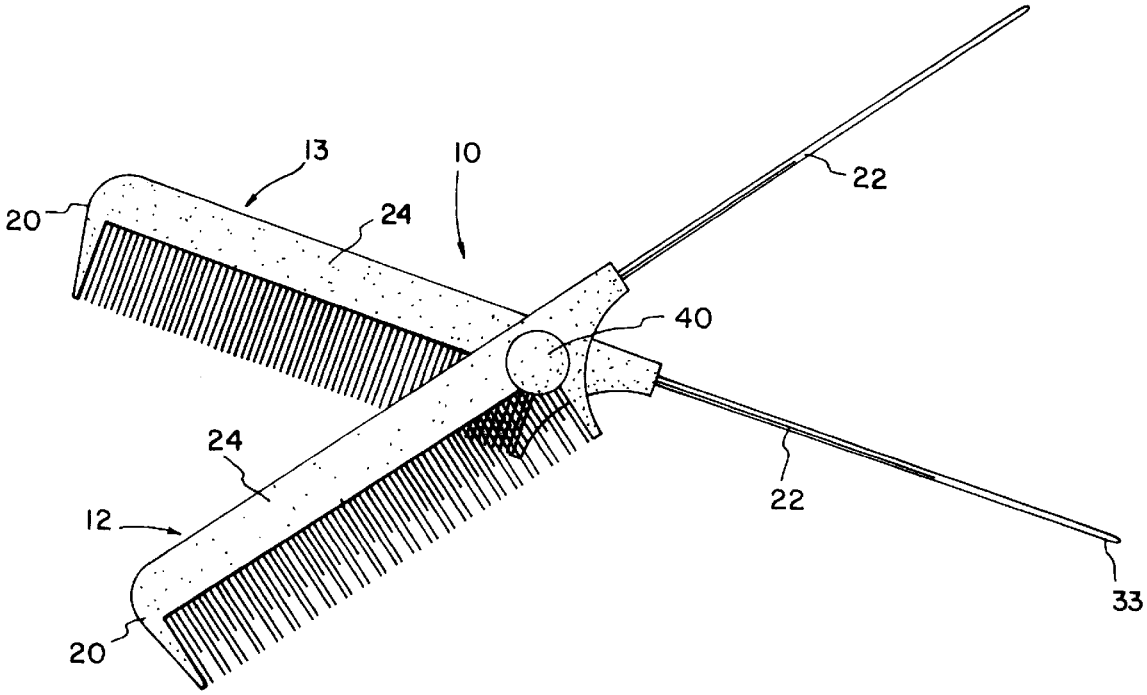
FIG. 2 is a mirror image side elevational view of the tease comb and hair pick of FIG. 1A in a rotated condition.
Figure 3:
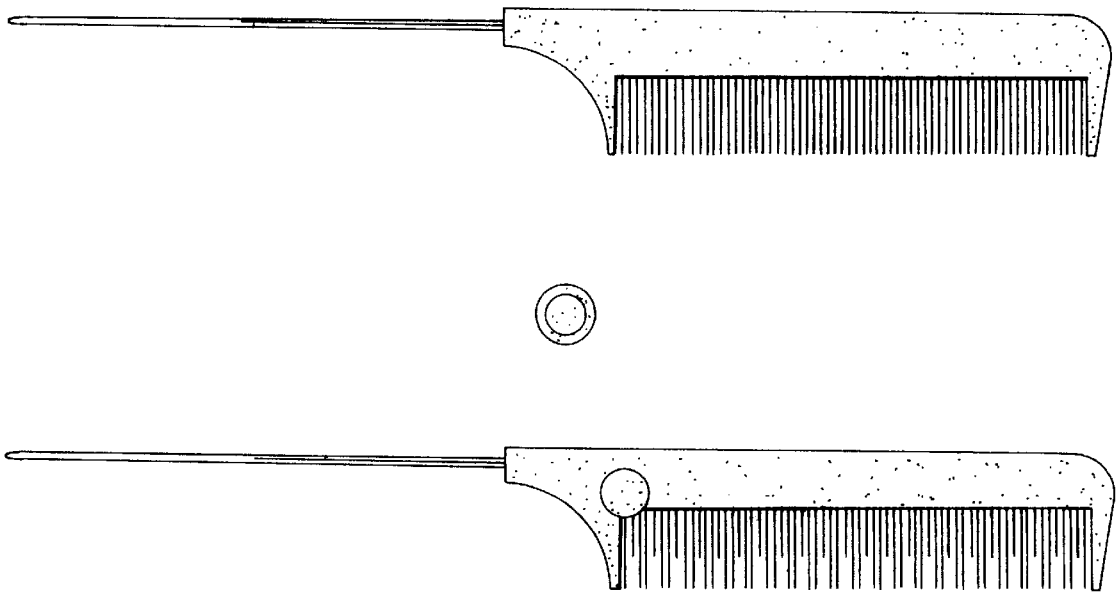
FIG. 3 is a disassembled side elevational view of the tease comb and hair pick shown in FIG. 1A.
Figure 5:
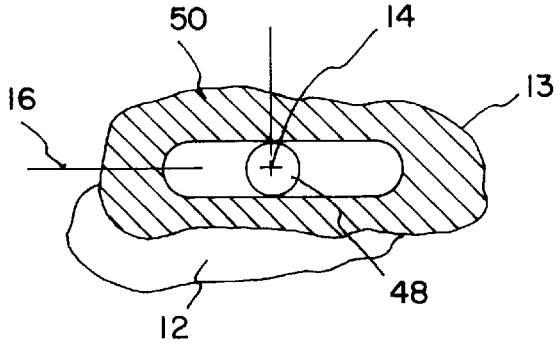
FIG. 5 is an enlarged fragmentary view of another embodiment of the present invention.
Figure 6:
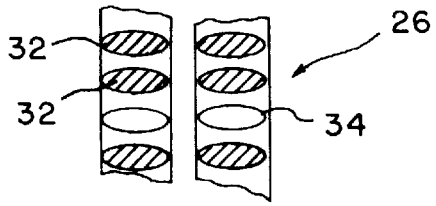
FIG. 6 is a cross sectional view taken along line 6—6 in FIG. 4.

Referring to drawing for the purpose of describing the preferred embodiments of the present invention, FIGS. 1 through 3 show a dual blade tease comb and hair pick 10 for use in styling hair using backcombing and teasing techniques. The comb and pick 10 comprises a first or front blade 12 and a second or rear blade 13. The blades 12 and 13 are pivotally connected in parallel juxtaposed relation for relative rotation about an axis 14 and relative translation along a horizontal longitudinal plane 16 (FIG. 5). Each blade 12 and 13 comprises a comb body 20 having an elongated cylindrical pick 22 extending rearwardly thereof. The comb body 20 has a longitudinal spine 24 and a uniform longitudinal series of laterally extending teeth 26 extending between a rear heel tooth 28 and a frontal tooth 30.

In the preferred form the teeth 26 comprise a pair of long teeth 32 spaced by a shorter tooth 34. A particularly effective comb and pick is commercially available from Champion as Model 43T. However, as shown in FIG. 1B the teeth may also comprise a uniform longitudinal series of equal length teeth with the respective blades fixedly connected. Preferably, the comb body 20 is formed of a low friction molded material such as urethane. The pick 22 is a metallic, polished rod integrally molded therewith and outwardly terminating with a tapered point 38.

The dual blade tease comb and hair pick utilizing the above described tandemly spaced tooth sets have been determined to produce sufficiently greater teased volume with less operator dexterity and in less time than a single unit employing similar teasing techniques. Such results are attained when the comb and picks are attached in permanent aligned juxtaposed parallel relation. Further improvements are realized when the comb and picks are pivotally connected and further when they are additionally relatively translatable.

In typical usage, a stylist will extend a grouping of hair strands, insert the comb teeth therein and repeatedly forwardly and backwardly manipulate the combs to establish a hair mat or teased volume adjacent the scalp. When using a single comb, it has been found that while portion of hairs are buckled or compressed during the downward stroke, many will partially return to extended positions during the upward stroke, thus undoing the desired effect. Further, the matted hair is typified by relatively long buckled overlapping hair sections of light density and compaction.

On the other hand, the laterally spaced sets of teeth of the present invention consistently produce more discrete overlapping of shorter compressed lengths, resulting in a greater density and increased volume for comparable teasing strokes. In usage it is not totally apparent what the exact reasons are for such results. However, it appears that the first teeth create an initial bucking of individual strands as they are released from the stylist's grasp. The partially buckled strands, particularly the strands no longer engaged by the first tooth set, are then engaged by the second tooth set, accentuating the compression toward the scalp. This results in additional matting for each strand. Moreover, it appears to leave lesser length free ends for the compressed strands decreasing the possibility of re-extending such strands during upward, reverse motion. Accordingly, fewer strokes are required to effect the teasing of the manipulated hair bundle.

Figure 4:
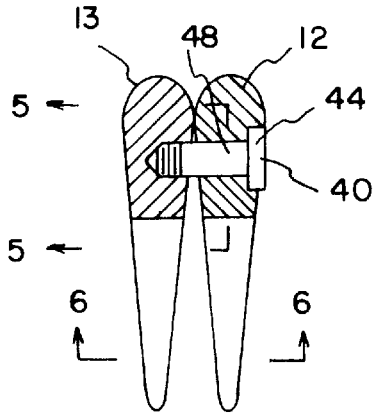
FIG. 4 is a cross sectional view taken along line 4—4 in FIG. IA.

The aforementioned results are further enhanced by providing relative pivotal and translational movement between the hair sets. Referring to FIGS. 1A, 2 and 4, a pivot pin 40 interconnects the heel portions of the comb and picks and accommodates relatively rotation about a transverse axis 14. The pin 40 includes a head section 44 received in a counterbore in the front side wall of the front blade 12 and a shank 48 slidably received in a through hole in the front blade 12 and fixedly received within a blind hole in the rear blade 13. In use, the stylist may manipulate the combs to rotated positions such as shown in exaggerated form in FIG. 3. During actual usage, such movement, while significant in producing surprising results, may only involve rotation of 10° or less.

Such relative rotation, by changing the angle of attack of the second comb appears to more affirmatively engage the initially buckling strands to drive the latter toward the scalp and to limit unwinding during upward movement. The location of the axis is conveniently located adjacent the heel end of the comb and pick for normal gripping by the stylist. This location has been found to provide for sensitive minute movements. However, the pivot connection may be positioned at other locations so as to achieve similar benefits.

Referring to FIG. 5, further benefits over the fixed tooth pairs may be provided by employing a sliding connection between the sets of comb teeth. Such a connection may be provided singularly or in combination with the pivotal connection. Such sliding connection may be accomplished in many ways. For instance, rather than a clearance hole in the front blade 12, the front blade may be provided with an elongated slot 50 for accommodating movement of the shank within the confines thereof. The slot 50 further accommodates rotation relative to the second blade. The resulting offsets between the tooth sets also provides for secondary engagement of the compressing hair strands.

After establishing the teased volume, the picks may be employed to lifts sections thereof into a proper orientation on the scalp to enhance further the desired styling effect. Whereas a single pick will lift only along the engaged line causing a creased effect requiring multiple insertions and movements to realign properly the teased volume, the relatively angularly spaced picks provided by the rotated comb picks allows discrete areas of the hair mat to be accurately and easily repositioned.

In achieving the foregoing advantages, it is important to laterally space the tooth sets in close proximity, generally ¾ inch or less, preferably ⅛ inch to ⅜ inch apart. Further, while various tooth configurations proposed in the art and those available commercially to the art may be used, good results have been achieved using teeth of uniformly varying lengths. Moreover, while many metallic or synthetic moldable compounds may be used for the comb body. Suitable synthetic compositions include urethanes, rubbers, nylons, acrylics, polycarbonates and the like.

While the present invention has been described with reference to the foregoing preferred embodiment, other modifications and variations thereof will become apparent to those skilled in the art. Therefore, it will be appreciated that modifications and variations are within the scope of the invention is defined by the following claims.

What is claimed:

1. A comb assembly, comprising: a pair of combs, each comb comprising an elongated spine, a longitudinal series of teeth depending from the spine, and connecting means between the combs positioning the teeth of the combs in laterally spaced relationship at a distance of loss than about ¾ inch wherein said connecting means pivotally and slidably interconnect said combs.

2. The comb assembly as recited in claim 1 wherein said distance is in the range of about ⅛ inch to ½ inch.

3. The comb assembly as recited in claim 1 wherein each comb includes an elongated cylindrical pick section extending rearwardly of said spine.

4. The comb assembly as recited in claim 1 wherein said teeth have a uniform length.

5. The comb assembly as recited in claim 1 wherein said teeth have varying lengths.

6. A method of creating a teased volume of hair adjacent a scalp section, comprising the steps of:

a. grasping a plurality of hairs;

b. extending said hairs from said scalp;

c. providing a first series of comb teeth and a second series of comb teeth, rotating said first series of teeth relative to said second series of teeth and engaging said plurality of hairs with said first series of comb teeth;

d. simultaneously engaging said hair with said second series of teeth behind and in close proximity to said first series of teeth;

e. moving said first series and said second series of teeth in tandem toward said scalp to establish a compacted volume of hair adjacent said scalp;

f. moving said first series of teeth and said second series of teeth in tandem away from said scalp while maintaining contact with non-compacted hair;

g. repeating said steps of moving until a desired compaction of hair adjacent the scalp has been attained; and h. providing elongated cylindrical hair picks in combination with said first series and said second series of teeth, relatively rotating said hair picks; inserting said hair picks into said compacted volume; and lifting said hair picks away from said scalp to reposition said compacted volume.

7. A dual blade teasing comb and hair pick, comprising:

a first comb unit and a second comb unit; each of said comb units including an elongated spine having a longitudinal series of teeth depending therefrom and an elongated cylindrical hair pick attached to a rear portion thereof and extending rearwardly thereof; and pin means pivotally interconnecting said spines of said comb units at said rear portions between said teeth and said hair picks, and accommodating relative pivotal movement therebetween and maintaining said spines in close parallel juxtaposition at a distance of less than about ¾ inch.

* * * * *